US010259631B2

(12) United States Patent
Zillges

(10) Patent No.: US 10,259,631 B2
(45) Date of Patent: Apr. 16, 2019

(54) EASY OPEN BUNDLED PACKAGED GOODS

(71) Applicant: Kimberly-Clark Worldwide, Inc., Neenah, WI (US)

(72) Inventor: Andrew David Zillges, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 71 days.

(21) Appl. No.: 15/119,589

(22) PCT Filed: Jan. 28, 2015

(86) PCT No.: PCT/US2015/013236

§ 371 (c)(1),
(2) Date: Aug. 17, 2016

(87) PCT Pub. No.: WO2015/130422

PCT Pub. Date: Sep. 3, 2015

(65) Prior Publication Data

US 2017/0066579 A1 Mar. 9, 2017

Related U.S. Application Data

(60) Provisional application No. 61/946,092, filed on Feb. 28, 2014.

(51) Int. Cl.
*A47K 10/18* (2006.01)
*A47K 10/20* (2006.01)
(Continued)

(52) U.S. Cl.
CPC ..... *B65D 71/063* (2013.01); *A47K 10/185* (2013.01); *A47K 10/20* (2013.01);
(Continued)

(58) Field of Classification Search
CPC ..... B65D 71/063; B65D 65/14; B65D 2571/00141; B65D 2571/0045; B65D 2571/00456; A47K 10/185; A47K 10/20
(Continued)

(56) References Cited

U.S. PATENT DOCUMENTS 2,122,013 A * 6/1938 Smith ..... F24F 3/1417 159/44
3,027,998 A 4/1962 Ridgeway
(Continued)

FOREIGN PATENT DOCUMENTS

DE 19821254 A1 11/1999
EP 1 785 357 A1 5/2007
(Continued)

*Primary Examiner* — Chun Hoi Cheung
(74) *Attorney, Agent, or Firm* — Kimberly-Clark Worldwide, Inc.

(57) ABSTRACT

The invention provides an easy to grasp handle and opening for packaging of individual packaged products that are sold in multi-packs, also referred to herein as bundles. The multi-pack is a plurality of individually packaged products that are over-wrapped together by a wrapper, such as a plastic film. In certain embodiments the packaged products comprise a package and a consumer good, such as facial tissue. The bundle of individually packaged products comprising a plurality of packages, wherein each of the plurality of packages contains at least one product and a film wrapper surrounding at least a portion of the plurality of packages, wherein the film wrapper comprises an overlapped portion having a first film wrapper layer and a second film wrapper layer, the overlapped portion having an attached zone and an unattached zone.

14 Claims, 4 Drawing Sheets

(51) Int. Cl.
*B65D 65/14* (2006.01)
*B65D 71/06* (2006.01)

(52) U.S. Cl.
CPC ..... *B65D 65/14* (2013.01); *B65D 2571/0045* (2013.01); *B65D 2571/00141* (2013.01); *B65D 2571/00456* (2013.01); *B65D 2571/00561* (2013.01); *B65D 2571/00672* (2013.01); *B65D 2571/00716* (2013.01); *B65D 2571/00728* (2013.01)

(58) Field of Classification Search
USPC ..... 206/770, 497, 499, 494; 229/87.05
See application file for complete search history.

(56) References Cited

U.S. PATENT DOCUMENTS 3,172,563 A 3/1965 Harwood
3,493,106 A 2/1970 Galli
3,878,943 A 4/1975 Ryan et al.
3,918,584 A 11/1975 Richardson
3,933,244 A 1/1976 Hughes et al.
4,586,312 A 5/1986 Limousin
4,623,074 A * 11/1986 Dearwester ..... A47K 10/421 206/494
4,680,340 A 7/1987 Oreglia et al.
5,048,687 A * 9/1991 Suzuki ..... B65D 71/10 206/494
5,545,685 A 8/1996 Davis et al.
5,657,870 A 8/1997 Schoettle et al.
6,491,161 B1 * 12/2002 Focke ..... B65B 19/228 206/264
6,880,313 B1 4/2005 Gessford et al.
8,640,870 B2 2/2014 Ruman
8,910,782 B2 * 12/2014 Koster ..... B65B 13/00 206/256
2002/0023924 A1 2/2002 Wisniewski et al.
2003/0234199 A1 12/2003 Morita et al.
2005/0050851 A1 3/2005 Osgood
2006/0032775 A1 * 2/2006 Forman ..... B65B 61/184 206/497
2007/0241016 A1 10/2007 Piczon
2009/0065560 A1 3/2009 Johnson
2010/0155292 A1 * 6/2010 Fell ..... B65B 11/48 206/738
2012/0177307 A1 * 7/2012 Duan ..... B65D 75/5833 383/211
2012/0279882 A1 11/2012 Prahm et al.
2013/0067864 A1 3/2013 Dwyer
2013/0213834 A1 * 8/2013 Koster ..... B65B 13/00 206/256
2014/0076918 A1 3/2014 Hailey et al.

FOREIGN PATENT DOCUMENTS

GB 1 397 709 A 6/1975
GB 2437359 A 10/2007
NL 1005648 C2 9/1998
WO WO 1994/001276 A1 1/1994
WO WO 1998-029311 A1 7/1998
WO WO 2005-014424 A1 2/2005
WO WO 2006-066682 A1 6/2006
WO WO 2006-066683 A1 6/2006

* cited by examiner

EASY OPEN BUNDLED PACKAGED GOODS

BACKGROUND

Merchandising of packaged goods has been enhanced in recent years by overwrapping the goods with a display band, or protective band of plastic film. The overwrap protects the packaged goods in transit and may include labeling and graphics that enhance appearance of the goods at retail. Generally the overwrap entirely surrounds the goods and must be removed and disposed of prior to consumption or use of the goods. Because the overwrap must often be removed prior to use it should be easily removable and its removal should not damage or otherwise diminish the usefulness of the packaged goods.

SUMMARY

One problem with prior art overwraps is that while they secure and protect the packaged goods in transit and on shelf they may be difficult for the user to remove prior to consumption of the goods. Another problem is that the overwraps do not provide anything for the user to grasp, making carrying and transport of the overwrapped bundle difficult. Also, prior art overwraps generally must be entirely removed from the packaged goods such that no overwrap remains leaving unconsumed goods unsecured. The present invention solves these problems by providing an overwrap that has a grasp handle and makes the bundle of packaged goods easy to transport and open. Further, the present invention provides an overwrap that remains partially intact after opening so as to secure the unused goods.

Accordingly, the present invention provides a bundle of packaged goods overwrapped with a film wrapper that not only secures and protects the packaged goods, but also permits the overwrap to be easily removed. Further, the invention provides an easy to grasp handle for transporting and opening the packaged goods. Also, the invention provides an overwrap that permits easy separation of the overwrap from a portion of the packaged goods without damaging the goods or disrupting the wrapping disposed over the unused goods.

Thus in one embodiment the present invention provides a bundle of individually packaged products comprising a plurality of packages, wherein each of the plurality of packages contains at least one product and a film wrapper surrounding at least a portion of the plurality of packages, wherein the film wrapper comprises an overlapped portion having a first film wrapper layer and a second film wrapper layer, the overlapped portion having an attached zone and an unattached zone.

In other embodiments the present invention provides a film package overwrapping individually packaged products, the flexible film package comprising a film having at least two opposing free edges, and at least a front panel and a back panel, the opposing free edges overlapping one another to form at least one overlapped portion, the overlapped portion having an attached zone and an unattached zone; a line of weakness disposed on the front panel.

In still other embodiments the present invention provides an overwrapped package of tissue cartons comprising a plurality of tissue cartons; a film overwrapping the tissue cartons, the film having two opposing free edges; an ink disposed proximal to one of the two opposing free edges, the ink defining a first printed area; at least one overlapped portion formed by the opposing free edges overlapping one another, the overlapped portion having an attached zone and an unattached zone, the unattached zone substantially corresponding to the first printed area; and a line of weakness disposed on the film overwrap.

In yet other embodiments the present invention provides an overwrapped package of tissue cartons comprising at least two tissue cartons in contact with one another along an interface, a plurality of interfolded tissue sheets disposed within the tissue cartons, and a film wrapper surrounding the at least two tissue cartons, the film wrapper having opposed first and second ends, the first and second ends overlapping to form an overlap portion having an attached zone and an unattached zone, and a line of weakness orientated substantially parallel to the first and second ends and proximal to the tissue carton interface.

DESCRIPTION

The invention provides an easy to grasp handle and opening for packaging of individual packaged products that are sold in multi-packs, also referred to herein as bundles. The multi-pack is a plurality of individually packaged products that are over-wrapped together by a wrapper, such as a plastic film. In certain embodiments the packaged products comprise a package and a consumer good, such as facial tissue. The cartons are formed from a carton blank. Generally the blank has a top surface with depending side flaps, a first side surface with depending side flaps, a bottom surface with side flaps and a second side surface with depending side flaps. The carton blank may be formed from a sheet of paperboard material.

In a particularly preferred embodiment the packaged products comprise packaged tissue products and more preferably a substantially cubic paperboard tissue carton having a plurality of folded tissue sheets disposed therein. In other embodiments the packaged products comprise a plurality of rolled tissue products. In yet other embodiments the packaged products comprise a disposable absorbent article, such as disposable diapers, training pants, incontinence pads and pants, sanitary napkins, tampons, pantiliners, wipes, wet wipes, bandages and pessaries disposed in carton, container, bag or overwrap. In certain embodiments the disposable articles are packaged in substantially cubic paperboard cartons, which are bundled together and wrapped as described herein. In other embodiments the absorbent articles are first overwrapped with a film to form a package and several packages then bundled and overwrapped as described herein.

Figure 1:
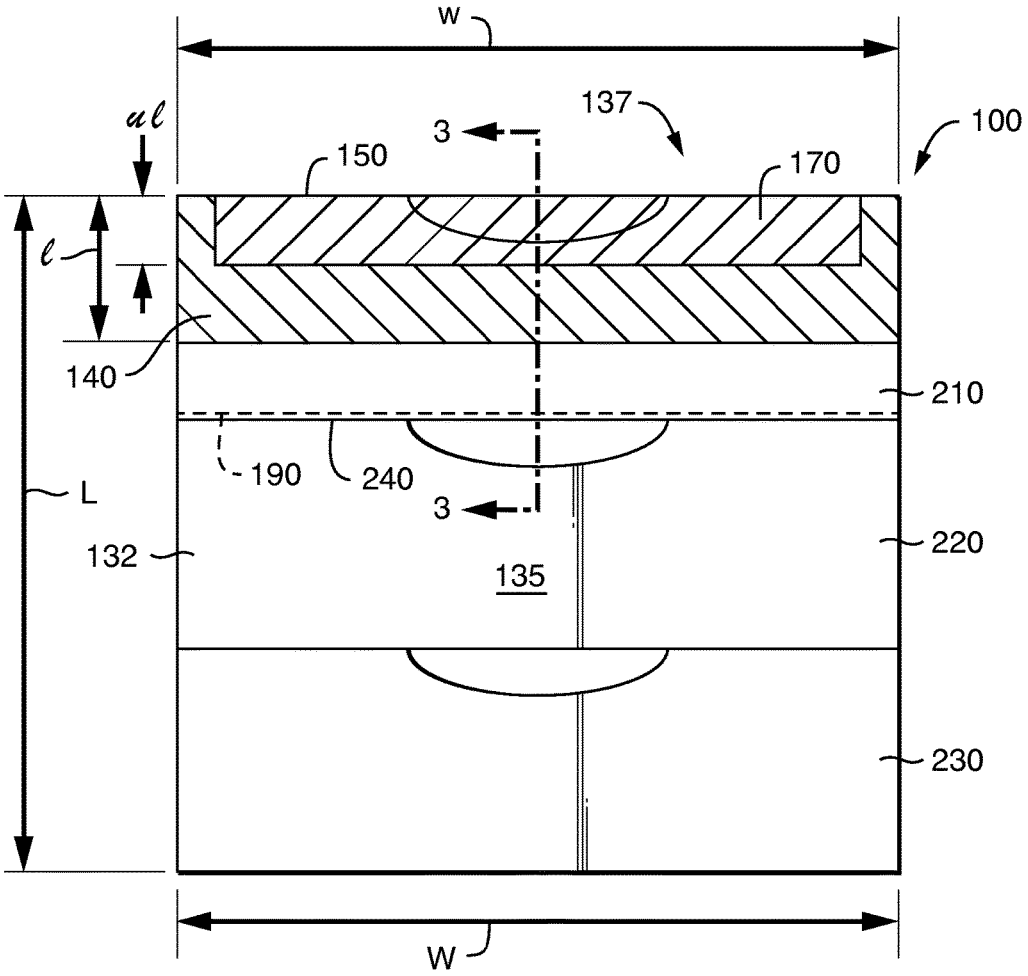
FIG. 1 is a front view of a bundle of packaged goods according to one embodiment of the present invention.
Figure 2:
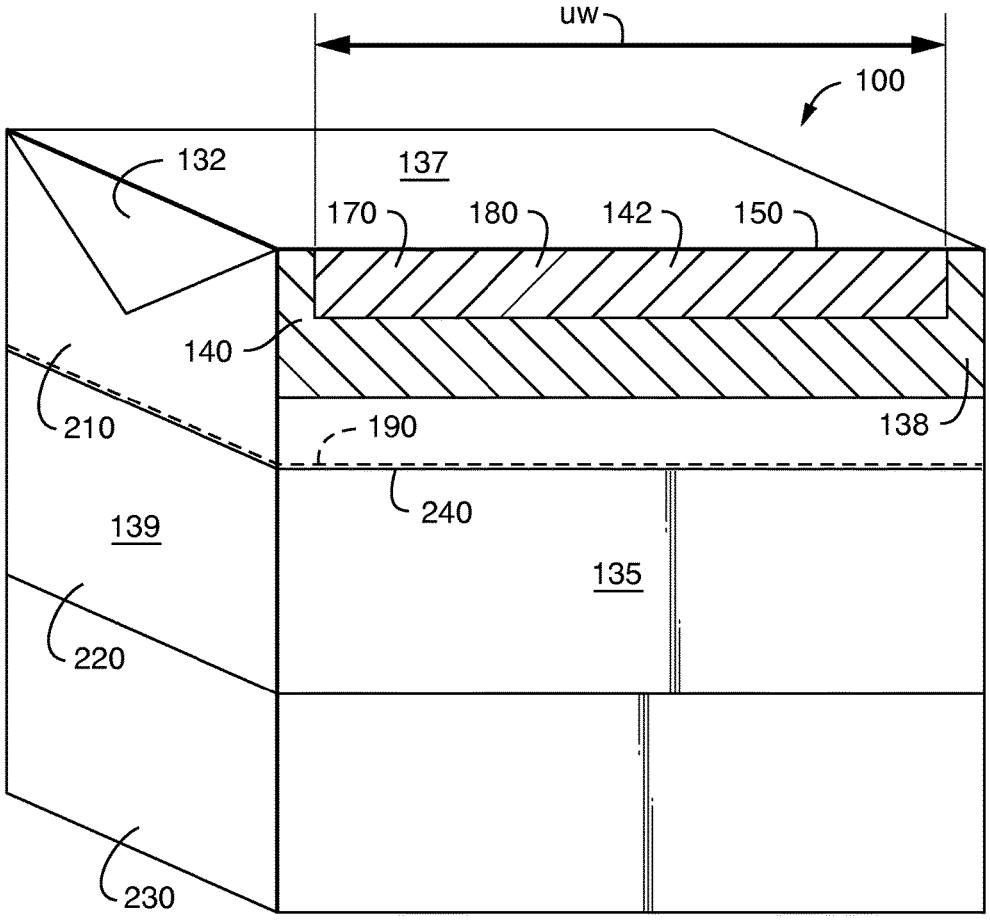
FIG. 2 is a perspective view of a bundle of packaged goods according to one embodiment of the present invention.

Referring to FIGS. 1 and 2, there is illustrated a product bundle 100. The product bundle 100 generally comprises a collection of packaged products, such as those disclosed above. The product bundle 100 is illustrated as a single outline having a cube shape having a front 135, top 137, opposing sides (left side 139 illustrated), bottom and back surfaces or sides. Although the illustrated bundle 100 is cubic, one skilled in art will appreciate that other shapes are contemplated. Generally, the shape of the bundle is dictated by the shape of the product items being bundled.

The illustrated bundle 100 comprises three packages 210, 220 and 230 of individually packaged products that are stacked on top of each other to form one column/stack. The packages 210, 220 and 230 are surrounded by a packaging film 132. Although the packaging film 132 substantially encloses the packages 210, 220 and 230 in the illustrated embodiment, the invention is not so limited. The film wrapper 132 may be in the form of a band for example, which only covers the front and back of the bundle. In other embodiments the film 132 may only cover the sides, top and bottom. In such an embodiment, the packaging film 132 encloses the lateral sides of the stacked packages 210, 220 and 230, but the front 135 and rear of the bundle are substantially free of packaging film 132 or could be partially covered by the packaging film 132. Preferably the film covers at least two surfaces of the packaged goods such that the goods are retained in the bundle in a stable manner.

The packaging film is preferably a plastic film, and more preferably a thermoplastic film with the thermoplastic being either a monolayer or a laminate. Useful monolayer or laminate thermoplastic materials include polyethylenes and ethylene copolymers, polypropylenes and propylene copolymers, polyethylene terephthalates, vinyl polymers and copolymers, and acrylic polymers and copolymers. The laminates include thermoplastic/paper laminates. A useful thermoplastic is biaxially oriented polypropylene. The invention is not limited to a plastic as the packaging film. In certain embodiments the packaging film may be a paper over-wrap or other material.

In embodiments where the packaging film 132 material is a plastic film, it will preferably have a gram weight/square meter (gsm) of about 15 gsm to about 75 gsm. The film material 132 will generally have a thickness of about 300 microns to about 600 microns. The film wrapper 132 material preferably will be a shrink wrap material.

As mentioned above, the bundle 100 can be used for many different products. However, it is useful in the marketing of consumer products and more particularly tissue products. Although three packages 210, 220 and 230 of individually packaged products are illustrated the invention is not so limited. For example, where tissue cartons are the product, the bundle 100 may have between 2 and 6 individually packaged products. Additionally, although only one column of packages is illustrated, the bundle 100 may comprise more than one column of packages.

Referring next to FIG. 2, one embodiment of the bundle 100 comprises a front surface 135 that is covered by the packaging film 132. The width of the packaging film 132 is designed to correspond to the width (W) of the bundle 100. A portion of the front surface 135 is covered by an overlapping first 134 and a second 136 layer of packaging film 132. The first 134 and second 136 layers overlap one another to form an overlapped portion 138 having a width (w) substantially corresponding to the width (W) of the bundle 100 and a length (l) that is generally only a fraction of the length (L) of the bundle 100. While the overlapped portion 138 is illustrated as occurring on the front surface 135 of the bundle 100, one skilled in the art will appreciate that the overlapped portion may be disposed on any one of the bundle surfaces. Moreover, while the overlapped portion is illustrated as being substantially rectangular, other shapes are contemplated so long as a portion of the bundle is overwrapped with two layers of packaging film.

The overlapped portion 138 has an attached zone 140 where the first 134 and a second 136 layer of packaging film 132 are attached to one another. The overlapped portion 138 also has an unattached portion 142 where the first 134 and a second 136 layer of packaging film 132 are not attached to one another. While the width and lengths of the attached 140 and unattached 142 zones is not of particular importance, it is preferred that relative size of the zones provides for a well-sealed bundle, but allows a user sufficient area to access the unattached zone to carry the bundle or to open the bundle.

Figure 3:
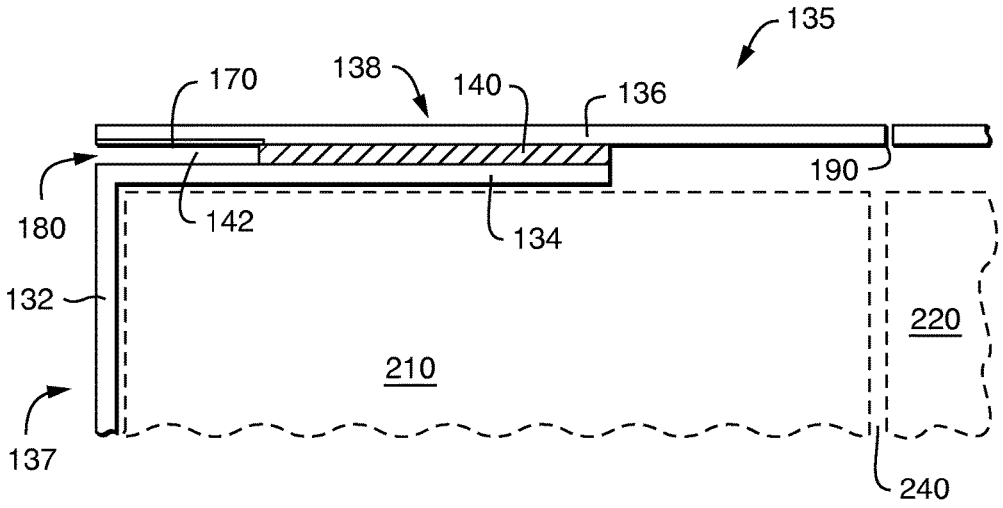
FIG. 3 is a cross-sectional view through the line 3-3 of FIG. 1.
Figure 4:
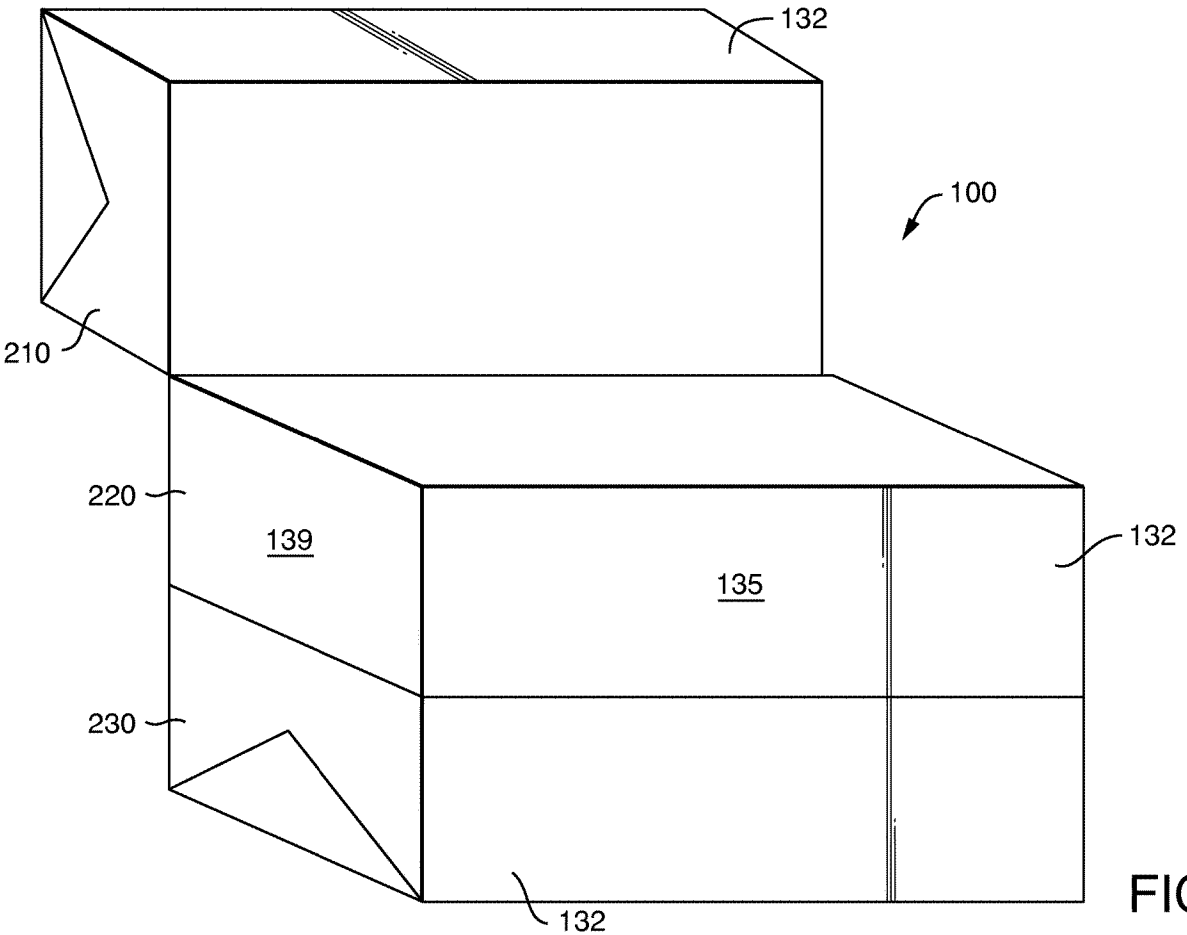
FIG. 4 is a perspective view of an opened bundle of packaged goods according to one embodiment of the present invention.

The attached 140 and unattached 142 zones are shown in greater detail in FIG. 3, which is a cross section view illustrating the overlapped portion 138. As illustrated, the overlapping layers 134, 136 have sealing surfaces that are brought into facing relation with one another. The attached zone 140 may be formed by bringing the two layers 134, 136 into contact with one another and sealing by adhesive, heat, pressure, or the like. Preferably the attached zone 140 is formed by a substantial degree of attachment between the two layers 134, 136. For example it is preferred that at least about 50 percent of the total surface area of the attached zone 140 comprises two layers 134, 136 attached to one another, and more preferably at least about 75 percent of the total surface area of the attached zone 140, such as from about 75 to about 100 percent of the total surface area of the attached zone 140. In certain embodiments a sealant layer can be applied to one or both sealing surfaces to facilitate the type of desired seal. This internal adhesive can be applied up to 100 percent of the interior surface or only where it is needed to provide a seal.

Also illustrated in FIG. 3 is the unattached zone 142 where the first 134 and a second 136 layer of packaging film 132 are not attached to one another. While it is preferred that the first 134 and a second 136 layer of packaging film 132 are not attached within the unattached zone 142, some degree of attachment may occur. Accordingly, in a preferred embodiment less than about 50 percent of the total surface area of the unattached zone comprises the first layer attached to the second layer, and more preferably less than about 25 percent, and more preferably less than 5 percent of the total surface area of the unattached zone comprises the first layer attached to the second layer.

Attachment between the first 134 and a second 136 layer may be prevented by partially coating the first 134 or second 136 layers with a material that is not thermally bondable. For example, using a lacquer to coat specific areas within the overlap and then exposing the overlap to a continuous sealing bar would result in an overlap portion 138 having attached 140 and unattached zones 142. Any material that is not thermally bondable may be used to prevent the two layers from attaching continuously. The material may be coated, for example, on the appropriate sides of overlapping margins. For example, a coating process (such as with an ink or varnish) can be used to deaden the overlapping area and prevent the two layers from attaching to one another. Alternately, a separate layer, such as a label or the like may be added to provide the non-attached portion of the overlapping film layers.

The unattached zone 142 forms a handle 180. In a particularly preferred embodiment the unattached zone 142 is formed by applying an adhesive deadening agent to at least one of the overlapping layers 134, 136. The adhesive deadening compound may be applied, for example, by flexo, gravure, or ink jet to one surface of the overlapping layers. The adhesive deadening agent inks, varnish, shellac, lacquer, polyolefins, paraffins, waxes, polyacrylates, polyurethanes, film forming polymers include, but are not limited to, polyvinyl alcohol, polyvinyl acetate, or combinations thereof. The deadening agent may be applied to select areas of one or both facing surfaces of the first and second layers 134, 136 of packaging film 132. Further, the deadening agent may be done in a pattern-applied approach such as by ink coating in a pattern-applied manner.

The handle 180 and package opening system will now be discussed further with reference to FIG. 2. As noted previously, the bundle 100 has a width (W) and length (L) and the packaging film 132 covers the entire front 135 of the bundle 100. A portion of the packaging film 132 is formed from an overlapped portion 138 which also has a width (w) and a length (l) and is represented by crosshatch markings to distinguish and differentiate the overlapping portion from those formed from a single layer of packaging film. It is noted that the crosshatch markings are not intended to represent opacity levels of the film and it is submitted that one or more of the films may be transparent, in various embodiments. The overlapped portion 138 has both an attached zone 140 (designated by hatch marks in FIG. 2) and an unattached zone 142 (designated by cross hatch marks in FIG. 2). In the illustrated embodiment the unattached zone 142 does not extend the entire width (W) of the bundle 100 or width (w) of the overlapped portion 138. Further, the unattached zone 142 does not extend the entire length (L) of the bundle 100 or length (l) of the overlapped portion 138.

In the illustrated embodiment the unattached zone 142, which forms the handle 180, is created by a first printed portion 170 disposed on the inner surface of the outer film layer 136. The printed portion 170 extends partially across the width (w) and length (l) of the overlapped portion. In this manner the printed portion 170 has a width and a length that corresponds to the width (uw) and a length (ul) of the unattached zone. The printed portion 170 overlaps a layer 134 of packaging film, however, the printing prevents the two layers 134, 136 of packaging film from attaching to one another. Thus, in the illustrated embodiment, the bundle 100 has a handle 180 formed from the overlapping unattached layers 134, 136 with an opening 182 orientated along the upper peripheral edge 150 of the bundle 100. The lateral edges of the handle 180 are formed by attached overlapping portions of film at opposite sides of the printed portion 170.

The handle 180 may assist a user in gripping and opening the product bundle 100. Accordingly, in use of the embodiments illustrated in FIGS. 1-2, a user can grip the unattached outer film layer 136 with one hand and pull the film away from the package to expose the package interior. For example, a user may grasp the handle 180 and pull in a direction ranging from upward (orthogonal to 136) to outward (orthogonal to 135) until the film breaches along the line of weakness 190. As the overlapping and attached film layers are separated and the film breaches/separates along the line of weakness 190 the bundle 100 is opened, exposing the contents of the bundle 100. Film 132 beyond the line of weakness 190 remains intact and continues to surround a portion of the packed goods.

In an exemplary embodiment, the overlapping portion of packaging film 132 extends from the top peripheral edge 150 of the bundle 100 for a length (l) of about 3 inches. The width (w) of the overlapping portion of packaging film extends substantially the width (W) of the bundle 100. Only a portion of the overlapping portion 138 of packaging film 132 is attached however, as the printed portion 170 inhibits the sealing of the top 136 and bottom 134 layers. This is a non-limiting example and in some embodiments the overlapping portion may extend a distance that is less than or greater than 3 inches.

The present embodiments can also provide a line of weakness in the film substrate to define a package opening. The line of weakness may be imparted by scoring or perforating the film. The score or perforation may be imparted by any known process, such as by mechanical, laser or other processes that would provide a line of weakness to compromise the integrity of the film. Generally perforations will extend entirely through the film forming an aperture, while scores will cut through only the exterior or interior surface of film. Scores and perforations need not be continuous to form a line of weakness. In some embodiments, the line of weakness may be formed by a combination of perforations and scores.

The preferred tear strength of line of weakness should be at least weaker than the strength of the film to allow the package to be opened along the line of weakness. The line of weakness may extend along the width (W) of the front 135 of the bundle 100, but can be configured in many embodiments depending on the anticipated product and how much product is desired to be exposed when the package is opened. For example, FIG. 2 illustrates one preferred embodiment in which the line of weakness is generally a straight line that extends the width (W) of the front 135 of the bundle 100. In this instance, the line of weakness 190 is positioned approximately parallel to the interface 240 between two abutting packages of goods 210 and 220. This type of configuration can be used for product containment—when the line of weakness 190 is compromised and the packaging film 132 opened the packages 220 and 230 below the line of weakness 190 remain overwrapped with packaging film 132. At the same time this configuration is useful for dispensing—when the line of weakness 190 is compromised and the packaging film 132 opened the package 210 above the line of weakness 190 is exposed and easily removed from the film 132.

Other arrangements of the line of weakness 190 relative to the packages 210, 220 and 230, are contemplated and within the scope of the present invention. By selectively positioning the line of weakness relative to the packages it is possible to provide an overwrap that opens completely around at least one of the packages, but maintains the other packages as a single unitary piece. For example, in use a user inserts a hand into the handle 180 and separates the attached layers by sliding their hand downward. Continuing downward the user splits the film along the line of weakness, opening the bundle. The user can then pull the upper most package out of the film wrapper, while the wrapper remains intact over the lower packages. In this manner, the overwrap remains as a single piece of material.

The line of weakness does not necessarily have to be straight. As formed in the overwrap, the weakness components and resultant line of weakness may be a diagonal line, a curved line or a line that changes direction by e.g. having angles, curves, and/or inflections such as inflection points. In order to obtain the line of weakness in this type of embodiment, the sheet of material will need to have the weakness components in the appropriate pattern. In one embodiment, the line of weakness originates in the withdrawal portion of the package and inclines such that it terminates in the central portion. Again, the line of weakness can be inclined at an angle from the plane perpendicular to the longitudinal axis. The angle of inclination is balanced against the desire to maintain the wrapper in a single piece. The smaller the angle, the greater the component of force applied to the package is translated into shear force that is able to rupture the line of weakness. However, a small angle of inclination provides a greater opportunity for the wrapper material to tear between the ends of the line of weakness to result in two separated package remnants. A larger angle of inclination provides a lesser opportunity for the wrapper material to tear between the ends of the line of weakness to result in two separated package remnants.

In another embodiment, the line of weakness is disposed in the upper third of the bundle. In still another embodiment, the line of weakness is a straight line that extends along a portion of each opposed side of the bundle and along the front of the bundle. In such embodiments, the upper most packaged good is easily removed after the line of weakness has been ruptured, which leaves the remaining packaged goods intact and overwrapped. This allows the user to easily open the bundle and remove a packaged good without having to unwrap all of the packaged goods.

In a particularly preferred embodiment, the line of weakness according to the present invention extends around three sides of the bundle. In this manner the line of weakness is arranged and configured such that upon the rupturing of the line of weakness, the resultant open overwrap can be removed as a unitary piece of material. As the line of weakness originates and ends at different parts of the seam, the line of weakness will not cause division of the wrapper into separate pieces upon opening. The end and origin of the line of weakness are sufficiently separated so as not to overlap and to reduce the likelihood of an undesired tear continuing between them.

In those embodiments where the line of weakness extends along the sides of the bundle, the line of weakness may extend through overlapping margins and seals. The overlapping of the margins and sealing does not compromise the line of weakness such that when the user opens the overwrap, the line of weakness tears completely around and through the sealed overwrap. The seal does not prevent the line of weakness from extending through the overlap region to effectively propagate a tear through this overlap region. If the line of weakness is formed from a series of slits, the forming of the seam in the margins will not close up the slits; rather the slits remain open sufficiently to be easily ruptured.

Generally the packaging film is such that when it is heated and comes into contact with a semi-rigid structure, the film does not shrink and distort significantly. However, any part of the packaging film that goes beyond the rigid structure of the product bundle will distort and shrink significantly. Further, when overlapping layers of packaging film are heated they preferably seal to one another. This sealing may be prevented by disposing printing on one surface of the packaging film. In this manner, when two layers of packaging film are brought into facing arrangement with one another the printed surface prevents the films from contacting one another and forming a seal when heated.

As described above, product items may be bundled together using an externally-applied packaging film, such as a clear or substantially transparent single or coextruded ply film made of a polymeric material, including polyethylene, polypropylene polyolefin, cellophane, or polyvinyl chloride or netting material. The film may be provided in the form of an open-ended sleeve or band, but may also be provided on one or more continuous rolls. A variety of techniques and machines for applying such a sleeve, band, or film over the product items and shrinking it to form a packaged product bundle is known in the art.

One exemplary technique uses the conventional "C-fold" wrapping technique, which relies on a single roll of packaging film manipulated into a C-shape for receiving a group of product items or articles. More specifically, a plurality of articles positioned adjacent to one another are advanced into the C-shaped film, such as by a pusher or conveyor. Once the group of articles is surrounded by the film on four sides, and an "L-bar" type sealing jaw including a heated knife or cutter is then used to sever and seal the film adjacent to the lateral (left or right) sides and the trailing side of the group of articles, in one embodiment. Other sealing technologies may also be employed, such as a cross bar seal technology, an air knife, among others. Further, a preformed tube of film may be used to envelope the product bundle during a wrap, in one embodiment, as an alternative to wrapping the bundle with a roll or rolls of film and sealing the ends. To illustrate, an elastic tube of film may be preprinted and mechanically opened and stretched to the size of the product bundle and pulled over the product bundle as a first or second wrap. The elasticity of the tube will then cause the bundle to tighten around the product bundle after being mechanically released.

Regardless of the wrapping technique used, in one embodiment, the film placed over, wrapped around, or covering the articles is then usually subjected to a heating process or restricting technology process such that it shrinks over the bundle, thereby temporarily securing the articles together against movement for more efficient distribution as unit.

In addition to the above mentioned embodiments the present invention provides, in a first embodiment, a bundle of individually packaged products comprising a plurality of packages, wherein each of the plurality of packages contains at least one product; a film wrapper surrounding at least a portion of the plurality of packages, wherein the film wrapper comprises an overlapped portion having a first film wrapper layer and a second film wrapper layer, the overlapped portion having an attached zone and an unattached zone.

In a second embodiment the present invention provides the bundle of the first embodiment comprising an adhesive deadening agent disposed on the first or second film wrapper layer.

In a third embodiment the present invention provides the bundle of the first or second embodiment wherein the bundle comprises an adhesive deadening agent selected from the group consisting of inks, varnish, shellac, lacquer, polyolefins, paraffins, waxes, polyacrylates, and polyurethanes.

In a fourth embodiment the present invention provides the bundle of the first through third embodiments further comprising an ink disposed on the first film wrapper layer, thereby forming the unattached zone.

In a fifth embodiment the present invention provides the bundle of the first through fourth embodiments wherein the overlapped portion has a length (l) and width (w) and the unattached zone has a length (ul) that is less than l and width (uw) that is less than w.

In a sixth embodiment the present invention provides the bundle of the first through fifth embodiments wherein the unattached zone has an open upper edge that is substantially parallel to the upper peripheral edge of the bundle.

In a seventh embodiment the present invention provides the bundle of the first through sixth embodiments further comprising a line of weakness disposed on the film wrapper.

In an eighth embodiment the present invention provides the bundle of the first through seventh embodiments wherein the packages are substantially cubic tissue cartons containing a plurality of interfolded tissue sheets.

What I claim is:

1. A bundle of individually packaged products having a pair of side panels and a front panel and an upper peripheral edge, the bundle comprising:

a. a plurality of packages abutting one another, wherein each of the plurality of packages contains at least one product;

b. a film wrapper surrounding at least a portion of the plurality of packages, wherein the film wrapper comprises an overlapped portion extending partially along the front panel, the overlapped portion having a first film wrapper layer and a second film wrapper layer, an attached zone and an unattached zone having an open upper edge that is substantially parallel to the upper peripheral edge of the bundle front panel;

c. a perforation disposed on the film wrapper a distance away from the attached and unattached zones and substantially parallel to the upper peripheral edge of the bundle and proximal to the interface of two abutting packages; and d. an adhesive deadening agent disposed on the first or second film wrapper layer.

2. The bundle of claim 1 wherein the adhesive deadening agent is disposed in a pattern substantially corresponding to the unattached zone.

3. The bundle of claim 2 wherein the adhesive deadening agent is selected from the group consisting of inks, varnish, shellac, lacquer, polyolefins, paraffins, waxes, polyacrylates, and polyurethanes.

4. The bundle of claim 2 wherein the adhesive deadening agent is an ink disposed on the first film wrapper layer in a pattern substantially corresponding to the unattached zone.

5. The bundle of claim 1 wherein the overlapping portion has a first length (l) and a first width (w) and the unattached zone has a second length (ul) that is less than the first length (l) and a second width (uw) that is less than the first width (w).

6. The bundle of claim 1 wherein the unattached zone has an open upper edge that is substantially parallel to the upper peripheral edge of the bundle.

7. The bundle of claim 1 wherein the packages are substantially cubic tissue cartons containing a plurality of interfolded tissue sheets.

8. The bundle of claim 1 wherein the perforation is disposed on the film wrapper such that it extends along the front panel and at least partially along the side panels of the bundle.

9. A flexible film package overwrapping individually packaged products, the flexible film package comprising a pair of side panels, a front panel and a back panel and an upper peripheral edge, a film having at least two opposing free edges arranged in facing relation, the opposing free edges overlapping one another to form at least one overlapped portion extending partially along the front panel, an adhesive deadening agent disposed on at least one of the free edges, the overlapped portion having an attached zone and an unattached zone formed by the adhesive deadening agent, the unattached zone having an open upper edge that is substantially parallel to the upper peripheral edge of the package; and a line of weakness disposed on the front panel a distance away from the attached and unattached zones and substantially parallel to the upper peripheral edge and extending along the front panel and at least partially along the side panels of the package.

10. The film package of claim 9 wherein the line of weakness is a perforation.

11. The film package of claim 9 wherein the adhesive deadening agent is selected from the group consisting of inks, varnish, shellac, lacquer, polyolefins, paraffins, waxes, polyacrylates, and polyurethanes.

12. The film package of claim 9 wherein the overlapping portion has a first length (l) and a first width (w) and the unattached zone has a second length (ul) that is less than the first length (l) and a second width (uw) that is less than the first width (w).

13. An overwrapped package of tissue cartons having a pair of side panels and a front panel and an upper peripheral edge, the package comprising:

a. a plurality of tissue cartons abutting one another;

b. a film overwrapping the tissue cartons, the film having two opposing free edges;

c. an ink disposed proximal to one of the two opposing free edges, the ink defining a first printed area;

d. at least one overlapped portion formed by the opposing free edges overlapping one another, the overlapped portion having an attached zone and an unattached zone, the unattached zone extending partially along the front panel and substantially corresponding to the first printed area and having an open upper edge that is substantially parallel to the upper peripheral edge of the package; and e. a line of weakness disposed on the film overwrap a distance away from the attached and unattached zones and proximal to the interface of two abutting packages and extending along the front panel and at least partially along the side panels of the package.

14. The overwrapped package of claim 13 wherein the overlapping portion has a first length (l) and a first width (w) and the unattached zone has a second length (ul) that is less than the first length (l) and a second width (uw) that is less than the first width (w).

* * * * *